US006484698B2

(12) United States Patent
Boecking

(10) Patent No.: US 6,484,698 B2
(45) Date of Patent: Nov. 26, 2002

(54) PRESSURE CONTROLLED INJECTOR FOR HIGH INJECTION WITH SLIDER THROTTLE

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/007,214

(22) Filed: Nov. 8, 2001

(65) Prior Publication Data

US 2002/0070286 A1 Jun. 13, 2002

(30) Foreign Application Priority Data

Nov. 8, 2000 (DE) ..... 100 55 267

(51) Int. Cl.[7] ..... F02M 37/04
(52) U.S. Cl. ..... 123/467; 123/300
(58) Field of Search ..... 123/467, 500, 123/501, 446, 299, 300; 239/88–96

(56) References Cited

U.S. PATENT DOCUMENTS 4,640,252 A * 2/1987 Nakamura et al. ..... 123/446
4,798,186 A * 1/1989 Ganser ..... 123/467
5,526,792 A * 6/1996 Guth et al. ..... 123/467
6,244,245 B1 * 6/2001 Boecking ..... 123/300
6,367,453 B1 * 4/2002 Igashira et al. ..... 123/467
6,371,084 B1 * 4/2002 Betz ..... 123/467
6,382,185 B1 * 5/2002 Mennicken et al. ..... 123/467

FOREIGN PATENT DOCUMENTS

DE 197 01 879 A1 7/1998

* cited by examiner

*Primary Examiner*—Carl S. Miller
(74) *Attorney, Agent, or Firm*—Michael J. Striker

(57) ABSTRACT

An injector for injecting fuel under high pressure into a combustion chamber of an internal combustion engine has an injector housing, a supply provided on the injector housing, a valve body, an actuator which imparts a vertical movement to the valve body in the injector housing, a closing element, a sealing seat for the closing element provided in the injector housing for releasing and for closing a supply from a high pressure collecting chamber, a nozzle chamber, a nozzle supply, a permanently acting throttle element branching from the nozzle supply to the nozzle chamber, and another throttle element regulatable by the valve body and branching from the nozzle supply to the nozzle chamber.

10 Claims, 2 Drawing Sheets

PRESSURE CONTROLLED INJECTOR FOR HIGH INJECTION WITH SLIDER THROTTLE

BACKGROUND OF THE INVENTION

The present invention relates to a pressure controlled injector for high injection with a slider throttle.

An injection system for injection of fuel which is under high pressure into the combustion chambers of an internal combustion engine must nowadays satisfy, in addition to other requirements, the following requirements: An injection pressure and an injection quantity for each operation point of the internal combustion engine must be determined independently from one another, to obtain an additional freedom for the of mixture. The injection quantity at the beginning of the injection must be as small as possible to take into account the ignition drag between the beginning of the injection and the adjusted formation of the flame front in the combustion chamber. For obtaining a constant injection pressure for all cylinders of the internal combustion engine high pressure collecting chambers (common rail) are used which serve as a common fuel distributor. Very high pressure acts in these chambers, so that during opening an injector the injection pressure for all other injectors can be maintained constant.

The German patent document DE 197 21 879 A1 discloses a fuel injection device for internal combustion engines. It is provided with a high pressure collecting chamber (common rail) which is filled with fuel through by a high pressure pump. This high pressure collecting chamber is connected via injection lines with injection valves which extend into the combustion chamber of the internal combustion engine to be supplied. Its opening and closing movements are controlled correspondingly by an electrically controlled control valve. The control valve is formed as a 3/2 way valve and connects a high pressure line which opens to an injection opening of the injection valve, with an injection line or a relieve line or an unloading line. A hydraulic working chamber which is filled with fuel high pressure is provided on the control member of the control valve. It is controllable, for adjusting the adjusting position of the control valve member of the control valve in an unloading passage.

SUMMARY OF THE INVENTION

It is an object of the present invention to provide an improved pressure controlled injector for a high injection with a slider throttling.

In keeping with these objects and with others which will become apparent hereinafter, one feature of present invention resides, briefly stated in an injector of this type in which from a nozzle supply to a nozzle chamber, a permanently acting throttling element and a throttling element which is regulated by a valve body are branched off.

With the inventive solution it is possible in a simple manner to realize a pressure controlled injector for injection of fuel into the combustion chamber of an internal combustion engine. Actually in the inventive solution through throttle points are associated with the high pressure side nozzle supply to the nozzle chamber which surrounds the nozzle needle, with which the shutoff can be regulated. One of the throttle points to which high pressure is applied through the nozzle supply is placed so that, it is closed by a slider which is displaceable vertically in the injector housing and can be opened by it, while a throttle point located underneath is positioned relative to the slider so that it is loaded permanently with high pressure. Since the first mentioned throttle point is located so that it can be closed or open by overlapping of the slider and the control edge in the injector housing, it is accessible for a regulation by controlling a piezo actuator.

With the inventive solution a fast closing of the nozzle needle in its seat is obtained, so that the fuel quantity injected for the beginning of the preinjection remains low and so that adjusting ignition drag can be taken into consideration. Depending on the desired injection end, it is possible by controlling the slider-side throttle element to provide an outflow of a greater quantity of fuel which is under high pressure from the nozzle supply through the further throttle point, so that the nozzle needle closes faster, so that the nozzle needle can close faster and can move back sealingly in its seat.

In addition to the throttle which is not closeable by the slider and therefore operates permanently, the further controllable throttle point provides for a possibility of acting on the pressure unloading in the nozzle supply, to perform a fast closing of an injection nozzle. What was mentioned before with respect to the preinjection phase is applicable for main injection or post injection phases of the injector, during the injection of fuel into the combustion chamber of an internal combustion engine.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
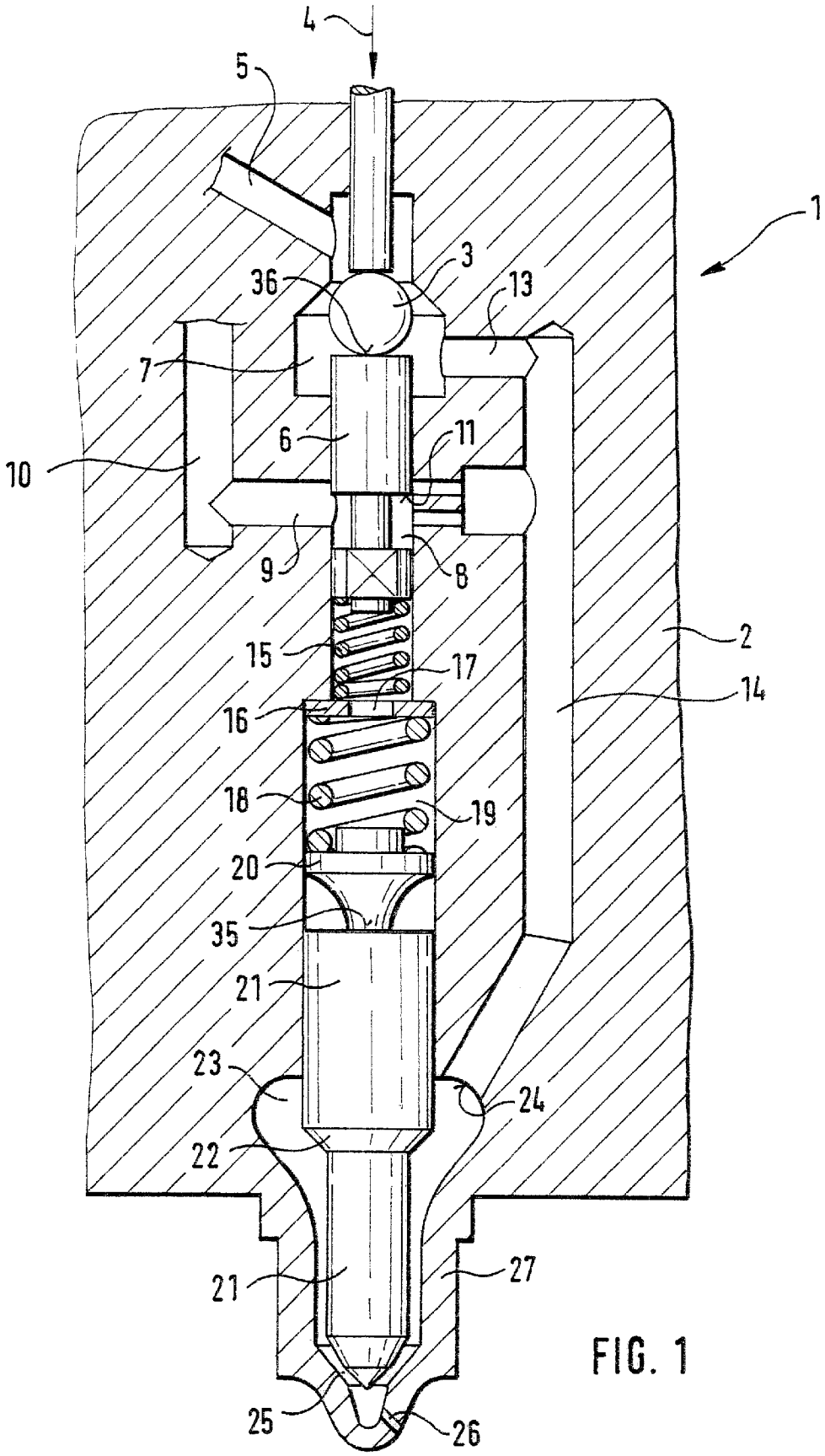
FIG. 1 is a view showing a longitudinal section through an injector in accordance with the present invention with a housing-side hollow chamber arranged under an actuator.

FIG. 1 is a view showing a longitudinal section of an injector in accordance with a first embodiment of the present invention.

The inventive injector in accordance with the FIG. 1 has an injector housing 2 with the hollow chamber 7 provided above a valve body 6 which is formed as a slider. The hollow chamber 7 serves for receiving a 2/2-way valve which is designed as a spherical element and identified as reference numeral 3.

An actuator which acts in an arrow direction 4 is located above the hollow chamber 7 provided at the housing side. The actuator acts on the valve body 6 which is vertically displaceable inside the injection housing 2 with inter position of the enclosing element 3 of the 2/2-way valve. The actuator can be formed as a piezoactuator or as a hydraulic-mechanical control element. Furthermore, for actuation of the 2/2-way valve, on the injector, a magnetic valve can be utilized. All used control elements for actuation of the 2/2-way valve provide a short response time.

A supply opening 5 of a high pressure collecting chamber (common rail) opens above the valve chamber 7 into the injection housing 2. A transverse opening 13 communicates with the hollow chamber 7 under the opening which is closable by the closing element of the 2/2-way valve, in which the supply 5 opens from the high pressure collecting chamber (common rail). The transverse opening 13 in turn opens into a nozzle supply opening 14 which extends parallel to the axis of the valve body 6 inside the injector housing 2, which opens into a nozzle supply opening identified with reference numeral 24 in a nozzle chamber 23 provided in the injection housing 2.

The closing element of the 2/2-way valve which is formed as a spherical body is supported on the one hand against a pressure pin which is loaded through the above mentioned actuator 4, and abuts at the other hand against the end surface 36 of the valve body 6 which is formed as a slider. The valve body 6 which is formed as a slider and extends from the hollow chamber 7 provided at the housing side, extends in a vertical direction downwardly and is formed as a rotation-symmetrical component which is surrounded by an opening 34 formed in the injector housing 2. A ring chamber 8 is formed at the valve body 6 which is formed in the slider. It is located in the region of the opening points of two throttle elements 30 and 31 provided in the injector housing 2. A transverse opening 9 formed in the injector housing 2 is located opposite to it and opens into a leakage oil discharge 10. The leakage oil discharge 10 in turn supplies back the excessive fuel into the fuel reservoir.

The ring chamber 8 at the valve body 6 represents a constriction, which makes possible an outflow of fuel under high pressure from throttle elements provided at the housing side through the transverse opening 9 in the injector housing 2 into the leakage oil-side drainage 10. A restoring spring 18 is located under the ring chamber 8 on the valve body 6 and abuts at one side against a disc 16 provided in the rejection housing 2 and on the other side against a lower end surface of the valve body 6. The restoring spring 15 provides a permanent abutment of the slider-side end surface 26 at the closing element 3 formed as a spherical body. For extending the service life of the end surface 36 of the valve body 6 which is subjected to mechanical loads, a surface finish can be provided by a special hardening process, so that a longer service life of the inventive injector shown in FIG. 1 can be obtained.

A spring chamber 19 is located under the abutment point 16 formed as a disc-shaped insert in the injector housing 2. The spring chamber 19 receives a sealing spring 18 which is formed as a spiral spring and supported against the lower side of the disc-shaped insert 16. The sealing spring 18 is supported intern against a spherical member 20. The conical member 20 has an abutment surface which is formed as a truncated cone and acts on an end surface 35 of the nozzle needle. The nozzle needle 21 which is received in the injection housing 2 extend in a vertical direction downwardly into a nozzle chamber 23. A pressure step 22 is formed inside the nozzle chamber 23 at the nozzle needle 21 which is pressed by the sealing spring 18 in its nozzle seat 25. Underneath the pressure step 23 the nozzle needle 21 is seated in direction of the nozzle seat 25 in a diameter which is smaller than the diameter located above the id pressure step 22. The reference numeral 25 identifies the nozzle seat, in which the injection hole 26 formed in the injection hole 26 formed in the injection housing 2 is closed.

It is to be understood that instead of the shown individual injection opening 26, several injection nozzles can be distributed relative to the symmetry axis of the nozzle needle 21 or valve body 6 in the injector housing 2 in the region which extends in the combustion chamber of an internal combustion engine. There can be in accordance with an opening pattern 4, 6 or more injection openings 26 located on a circle. The injection opening 26 extends in the same diameter through the opening 27 of the injector housing 2. Through the injection opening 26 the nozzle needle 21 under high pressure opens by the opening movement of the needle nozzle 21 against the sealing action of the sealing spring 18 into the combustion chamber of an internal combustion engine.

The operation of the inventive injector in accordance with the embodiment of FIG. 1 is as follows.

By actuation of the piezo control element in an actuating direction corresponding to the arrow in FIG. 1, the plunger rod moves to the 2/2-way valve which includes a spherical closing body. Thereby the periphery of the spherically configurated closing element releases the sealing seat, and fuel which is under extremely high pressure from the high pressure collecting chamber through the supply 5 acts as an impact in the hollow chamber 7 inside the injector housing 2. The fuel flows from the hollow chamber 7 in the embodiment of FIG. 1 through the transverse opening 16 inside the injector housing in a nozzle supply 14, to enter the nozzle chamber 23 with high pressure. With the fuel quantity which enters under high pressure the nozzle chamber 23 which is formed in the injector housing 2 in accordance with the present invention, acts on the pressure step 22 of the nozzle needle, an opening force acts against the pressure step 22 of the nozzle needle 21, which counteracts the closing force produced by the sealing spring 18 and the hollow chamber 19. With the pressure which acts in the high pressure collecting chamber and enters the nozzle chamber 23, the needle nozzle 21 opens against the actuating direction of the spring 18. The nozzle needle 21 moves in a vertical direction, and it is supported at the sealing spring 18 and the disc-shaped supporting element 16 provided in the injector housing 2. The needle nozzle 21 moves, release the sealing seat, 6.1 so that the fuel which is under high pressure can enter the combustion chamber of an internal engine through the injection opening 26, for example during its pre-injection phase.

In order to provide a fast closing of the nozzle needle 21, two throttle elements 30 and 31 are associated with the nozzle supply 14. The lower throttle element 31 is a permanently loading throttle element, since it is not breached by the slider 11 of the valve body 6 and thereby can not be closed. Therefore after the end of the pre-extension phase for example a pressure unloading of the pressure supply 14 is performed through the lower of the two housing-side throttling points 30, 31. The fuel under high pressure flows from the opening of the throttle 31 into the nozzle chamber 23 and thereby the nozzle supply 14 in the ring chamber 18 inside the slider opening 34 provided at the housing side, to enter the leakage oil line 10 through the transverse opening 4. From there fuel flows back into the fuel reservoir in order to be again supplied being compressed by a high pressure pump provided in the circuit, into the high pressure chamber of the fuel injection system.

Figure 1A:
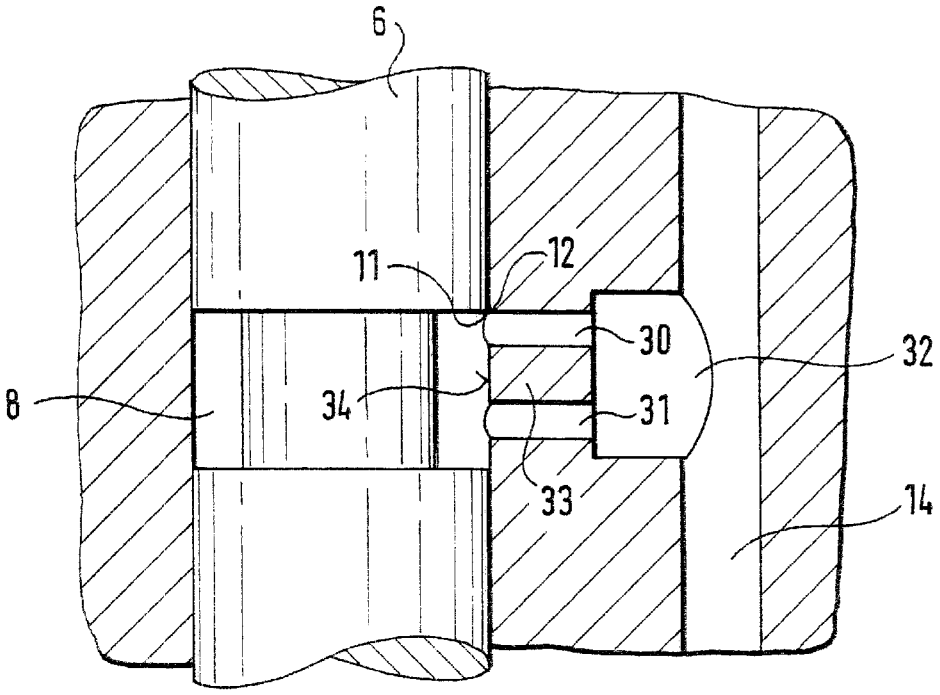
FIG. 1*a* is a view showing a position of the throttle points with respect to a slider and a high pressure-side nozzle supply, on an enlarged scale.

The throttle points are shown in an enlarged scale with respect to the slider in FIG. 1*a*.

In order to provide a further pressure unloading of the pressure supply which is loaded with fuel under high pressure and thereby of the nozzle chamber 23 which surrounds the nozzle needle 21, the valve body 6 which is formed as a slider can move farther, the slider 18 is moved upwardly as far as possible under the action of the actuation 14 in a vertical direction, the slider edge 11 moves to the height of the control edge 12 provided at the housing, and thereby the full cross-section of the upper throttle element 30 is released. The release of the additionally provided regulatable throttle point 30 makes possible the outflow of a greater fuel quantity from the nozzle supply 14 through the ring chamber 8 into the leakage lines 9 or 10 shown in FIG. 1. The both throttle passages 30 or 31 are connected with an opening 32 which is common for both throttle elements. A web 33 is located between the throttle points 30 and 31 which are formed as passages in the injector housing 2. Both throttle passages 30 and 31 open inside the constriction of the valve body 65 which is formed as a ring chamber 8. Therefore the fuel which exits the throttle passages 30 and 31 can flow directly through the transverse opening 9 and the leakage opening 10 back into the fuel reservoir.

Since the slider 11 is designed so that during the vertical movement of the valve body 6 in the vertical direction after the actuation of the actuator 4 it can cover the passage of the upper throttle element 30, the passage of the lower throttle element 31 can not be engaged by the action of the slider 11. The lower throttle 31 is formed as a permanently acting throttle point, while in contrast to this, the regulatable throttle point which is arranged above the same can be released by the actuator completely, partially or in different stages by movement of the slider 11 in accordance with the vertical movement of the valve body 6 in the injector housing 2, depending on the control. Since the position of the valve body 6 or its slider edge 11 with respect to the control edge 12 provided in the housing can be regulated, therefore additionally to the permanently acting throttle point 31, a regulatable throttle point is provided in the injector housing 2. This regulatable throttle point 30 when needed can provide a fast control of the nozzle needle 21 in its sealing seat 25, so that within a pre-injection phase the fuel volume in it flows in the combustion chamber through the injection opening 26 can be injected so that it is exactly determined with respect to the ignition drag. The quantity injected during the pre-injection is not influenced in the inventive solution by the impact-like outward movement of the nozzle needle and by dynamic opening forces causes inaccuracies of the injection quantity. Moreover, during the pre-injection a considerably faster closing of the nozzle needle 21 and its sealing seat 25 is obtained, which is required for accurately maintaining the metered fuel quantity during the pre-injection.

Figure 2:
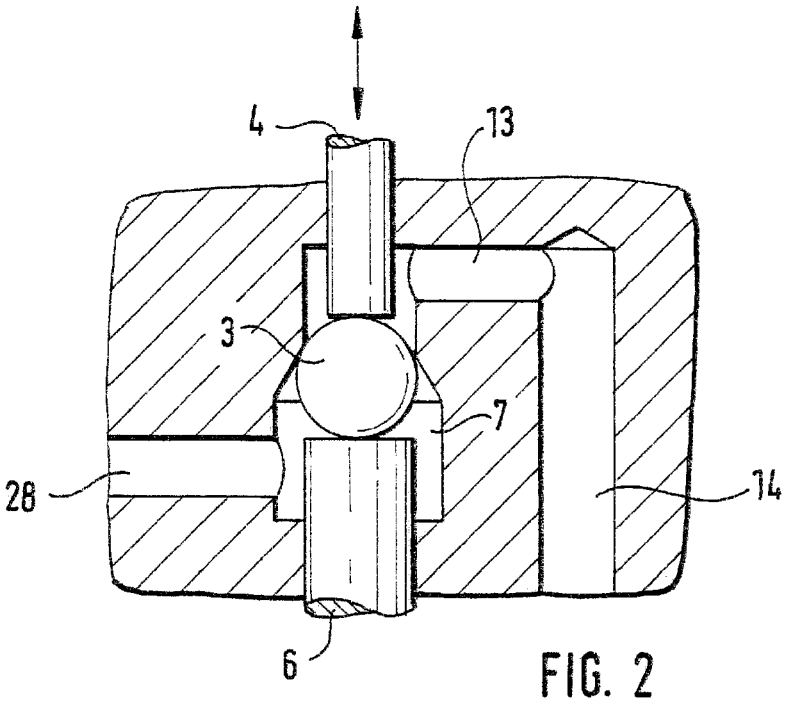
FIG. 2 is a view showing another embodiment of the hollow chamber provided at the side of the housing in an upper region of the injector.

FIG. 2 shows another embodiment of the hollow chamber inside the injection housing. The adjusting movements of the piezo actuator 4 are identified by a double arrow in FIG. 2. The piezo actuator 4 performs this movement with respect to the control valve which is formed as a 2/2-way valve. Depending on the control of the actuator 4, an opening of the spherically formed closing element 3 at its sealing seat inside the injector housing 2 is performed, or a pressure unloading at the plunger rod-shaped element takes place, so that the closing element 3 which is formed as a spherical body moves in its housing-side sealing seat. The supply from high pressure collecting chamber is identified with reference numeral 28 and it opens in the hollow chamber 7 in the injector housing 2. It is loaded with fuel under high pressure. During operation of the actuator in a vertical direction downwardly, the closing element 3 of the 2/2-way valve is pressed downwardly, the valve body 6 which is shown schematically moves downwardly, so that the sealing seat in the hollow chamber 7 is released and the fuel which exits the high pressure collecting chamber from the supply 28 under high pressure flows through the transverse opening 13 into the nozzle supply 14. The fuel which is under high pressure flows from the nozzle supply 14 to the nozzle chamber 23 for entering the same, and for controlling the opening movement of the needle nozzle 21 against the sealing spring 18 arranged in the spring chamber 19 (compare the embodiment of FIG. 1.)

The embodiment of the hollow chamber 7 in accordance with FIG. 2 provides a further possibility for positioning the nozzle supplies 28 and 5 of FIG. 1 relative to one another.

It will be understood that each of the elements described above, or two or more together, may also find a useful application in other types of constructions differing from the types described above.

While the invention has been illustrated and described as embodied in, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

I claim:

1. An injector for injecting fuel under high pressure into a combustion chamber of an internal combustion engine, comprising an injector housing; a supply provided on said injector housing; a valve body; an actuator which imparts a vertical movement to said valve body in said injector housing; a closing element; a sealing seat for said closing element provided in said injector housing for releasing and for closing a supply from a high pressure collecting chamber; a nozzle chamber; a nozzle supply; a permanently acting throttle element branching from said nozzle supply to said nozzle chamber; and another throttle element regulatable by said valve body and branching from said nozzle supply to said nozzle chamber.

2. An injector as defined in claim 1, wherein said valve body has an end surface, said actuator acting on said end surface of said nozzle body with interposition of said closing element.

3. An injector as defined in claim 1, wherein said throttle elements have openings, said valve body being formed as a slider; and further comprising a ring chamber formed on said valve body in the region of said openings of said throttle elements.

4. An injector as defined in claim 1; and further comprising a restoring element which pre-tensions said valve body in said injector housing and acts on its seat surface in a closing direction of said closing element.

5. An injector as defined in claim 1; and further comprising a common opening from said nozzle supply provided for said throttle elements at a side of said nozzle supply.

6. An injector as defined in claim 1, wherein said regulatable throttle element is positioned in said housing so that when said closing element moves in said sealing seat said regulatable throttle element is opened by said slider and a control edge in said injector housing over its whole cross-section.

7. An injector as defined in claim 1, wherein said supply from the high pressure collecting chamber is arranged relative to said hollow chamber above said nozzle supply.

8. An injector as defined in claim 1, wherein said supply from the high pressure collecting chamber is arranged relative to said hollow chamber under said nozzle supply.

9. An injector as defined in claim 3; and further comprising a leakage oil line provided with an opening which is placed opposite to said ring chamber.

10. An injector as defined in claim 1; and further comprising an actuating unit provided for a 2/2-way valve and formed as a piezo actuator.

* * * * *